US005578407A

United States Patent [19]

Kasuya et al.

[11] Patent Number: 5,578,407

[45] Date of Patent: Nov. 26, 1996

[54] COLOR TONER FOR DEVELOPING ELECTROSTATIC IMAGES, PROCESS FOR ITS PRODUCTION, AND COLOR IMAGE FORMING METHOD

[75] Inventors: Takashige Kasuya, Soka; Tatsuya Nakamura, Tokyo; Makoto Kanbayashi, Kawasaki; Tatsuhiko Chiba, Kamakura; Kazuyuki Miyano, Tokyo; Koji Inaba, Yokohama, all of Japan

[73] Assignee: Canon Kabushiki Kaisha, Tokyo, Japan

[21] Appl. No.: 330,542

[22] Filed: Oct. 28, 1994

[30] Foreign Application Priority Data

Oct. 29, 1993 [JP] Japan ..... 5-292432
Oct. 14, 1994 [JP] Japan ..... 6-274317

[51] Int. Cl.[6] ..... G03G 9/09

[52] U.S. Cl. ..... 430/106; 430/111; 430/137; 430/42

[58] Field of Search ..... 430/106, 111, 430/137

[56] References Cited

U.S. PATENT DOCUMENTS

| | | | |
|---|---|---|---|
| 2,297,691 | 10/1942 | Carlson | 430/31 |
| 4,077,804 | 3/1978 | Vanzo | 428/407 |
| 4,592,990 | 6/1986 | Takagi et al. | 430/137 |
| 4,609,607 | 9/1986 | Takagi et al. | 430/106.6 |
| 5,116,712 | 5/1992 | Nakamura et al. | 430/106 |
| 5,130,220 | 7/1992 | Nakamura et al. | 430/109 |

FOREIGN PATENT DOCUMENTS

| | | |
|---|---|---|
| 2360918 | 3/1978 | France . |
| 61-10231 | 1/1986 | Japan . |
| 2-275964 | 11/1990 | Japan . |
| 2-293865 | 12/1990 | Japan . |
| 3-015861 | 1/1991 | Japan . |
| 1583564 | 1/1981 | United Kingdom . |

*Primary Examiner*—Roland Martin
*Attorney, Agent, or Firm*—Fitzpatrick, Cella, Harper & Scinto

[57] ABSTRACT

A color toner for developing an electrostatic image has color toner particles containing a binder resin and a colorant.

The color toner particles have been obtained by mixing a mixture containing at least a polymerizable monomer, the colorant and a polymerization initiator to prepare a polymerizable monomer composition, dispersing the polymerizable monomer composition in an aqueous medium to carry out granulation, and polymerizing polymerizable monomers in the aqueous medium.

The colorant comprises fine organic pigment particles or fine organic dye particles having an acetic acid adsorption heat in n-heptane of from 0.1 $mJ/m^2$ to 80 $mJ/m^2$.

30 Claims, 1 Drawing Sheet

COLOR TONER FOR DEVELOPING ELECTROSTATIC IMAGES, PROCESS FOR ITS PRODUCTION, AND COLOR IMAGE FORMING METHOD

BACKGROUND OF THE INVENTION

1. Field of the Invention

This invention relates to a color toner for developing electrostatic images, a process for its production, and a color image forming method.

2. Related Background Art

For electrophotography, a large number of methods are known in the art as disclosed, for example, in U.S. Pat. No. 2,297,691. In general, in this aspect of electrophotography, an electrostatic latent image is formed on a photosensitive member, utilizing a photoconductive material and according to various means, and subsequently the latent image is developed using the toner to form a toner image. The toner image is transferred to a transfer medium such as paper if necessary, and then the toner image thus transferred is fixed to the transfer medium by heating, pressing, heat-pressing or using solvent vapor. A copy is thus obtained.

Various methods have been hitherto proposed as methods for developing latent images using toners and methods for fixing toner images, and methods suited for their respective image forming processes are employed.

Toners used for such purposes have been commonly produced by melt-kneading a thermoplastic resin and a colorant comprising a dye and/or a pigment to uniformly disperse the colorant in the thermoplastic resin, followed by cooling, pulverization and classification to obtain a toner having the desired particle diameters.

This production process (a pulverization process) can produce reasonably good toners, but has certain kinds of limitations, for example, a limitation to the range of selecting toner materials. For example, dispersions of resins with colorants must be brittle enough to be pulverizable by an economically usable production device. Since the dispersions must be made very brittle, groups of particles having a broad range of particle diameter tend to be formed when actually pulverized at a high speed. In particular, a problem may arise such that particles excessively pulverized tend to be included in such groups of particles in a relatively large proportion. Moreover, materials with such a brittleness tend to be further pulverized or powdered when actually used for development in image forming apparatus such as copying machines.

In the pulverization process, it is not easy to uniformly disperse fine solid particles such as colorants in resins. An increase in fog and a decrease in image density may be caused depending on the degree of dispersion of such fine solid particles, and hence great care must be taken. Colorants coming free rupture cross-sections of resin particles colored with the colorants which may cause variations in developing performance of toners.

Meanwhile, to overcome the problems in the toners produced by pulverization, processes for producing toners by suspension polymerization are proposed (Japanese Patent Publication No. 36-10231, British Patent No. 1,583,564, U.S. Pat. No. 4,592,990 and U.S. Pat. No. 4,609,607, etc.). In this suspension polymerization, a monomer composition is prepared by uniformly dissolving or dispersing a polymerizable monomer and a colorant (optionally together with a polymerization initiator, a crosslinking agent, a charge control agent and other additives), and thereafter dispersing the monomer composition by means of a suitable stirrer in a continuous phase (e,g, an aqueous phase) containing a dispersion stabilizer, to cause polymerization to simultaneously take place to obtain toner particles having the desired particle diameters.

The process for producing toners by suspension polymerization enables encapsulation of a low-melting material such as wax into toner particles and does not require the step of pulverizing resins. Hence, the process has the advantages that the energy to be used during the production of toners can be saved and also the step of classifying toner particles can be omitted.

In the process for producing toners by pulverization, it is possible to use pigments of dyes having a polymerization inhibitory action. However, in the process for producing toners by suspension polymerization, some colorants exhibit a remarkable polymerization inhibitory action, and it is important to select proper colorants.

As a method for preventing or prohibiting the polymerization inhibitory action of colorants, Japanese Patent Application Laid-open No. 2-275964, corresponding to U.S. Pat. No. 5,130,220, discloses a method in which a dye or pigment having a polymerization inhibitory action is treated by bulk polymerization, followed by suspension polymerization to produce a toner. According to this method, toner particles can be formed by suspension polymerization while preventing or prohibiting the polymerization inhibitory action of the dye or pigment. However, it is still,sought to provide a process for producing toners by suspension polymerization that can produce a toner having a higher coloring power, a superior triboelectric chargeability and a sharp particle size distribution.

SUMMARY OF THE INVENTION

An object of the present invention is to provide a color toner for developing electrostatic images, having solved the problems discussed above, and a process for producing such a toner.

Another object of the present invention is to provide a color toner for developing electrostatic images, having a superior triboelectric charging performance, and a process for producing such a toner.

Still another object of the present invention is to provide a color toner for developing electrostatic images, having a high coloring power, and a process for producing such a toner.

A further object of the present invention is to provide a color toner for developing electrostatic images, having a sharp particle size distribution, and a process for producing such a toner.

A still further object of the present invention is to provide a color image forming method for forming multi-color or full-color images having a superior color tone reproduction, using the above color toner.

The present invention provides a color toner for developing an electrostatic image, comprising color toner particles containing a binder resin and a colorant;

the color toner particles having been obtained by mixing a mixture containing at least a polymerizable monomer, the colorant and a polymerization initiator to prepare a polymerizable monomer composition, dispersing the polymerizable monomer composition in an aqueous medium to carry out granulation, and polymerizing polymerizable monomers in the aqueous medium;

wherein the colorant comprises fine organic pigment particles or fine organic dye particles having an acetic acid adsorption heat in n-heptane of from 0.1 $mJ/m^2$ to 80 $mJ/m^2$.

The present invention also provides a process for producing a color toner, comprising the steps of:

mixing a mixture containing at least a polymerizable monomer, a colorant and a polymerization initiator to prepare a polymerizable monomer composition, wherein the colorant comprises fine organic pigment particles or fine organic dye particles having an acetic acid adsorption heat in n-heptane of from 0.1 $mJ/m^2$ to 80 $mJ/m^2$;

dispersing the:polymerizable monomer composition in an aqueous medium to carry out granulation; and polymerizing polymerizable monomers in the aqueous medium.

The present invention still also provides a color image forming method comprising;

i) developing an electrostatic image formed on a latent image bearing member, using a cyan color toner to form a cyan toner image, wherein;
   the cyan color toner comprises cyan color toner particles containing a binder resin and a cyan colorant;
   the cyan color toner particles have been obtained by mixing a mixture containing at least a polymerizable monomer, the cyan colorant and a polymerization initiator to prepare a polymerizable monomer composition, dispersing the polymerizable monomer composition in an aqueous medium to carry out granulation, and polymerizing polymerizable monomers in the aqueous medium; and
   the cyan colorant comprises fine organic cyan pigment particles or fine organic cyan dye particles having an acetic acid adsorption heat in n-heptane of from 0.1 $mJ/m^2$ to 80 $mJ/m^2$;

ii) developing an electrostatic image formed on the latent image bearing member, using a magenta color toner to form a magenta toner image, wherein;
   the magenta color toner comprises magenta color toner particles containing a binder resin and a magenta colorant;
   the magenta color toner particles have been obtained by mixing a mixture containing at least a polymerizable monomer, the magenta colorant and a polymerization initiator to prepare a polymerizable monomer composition, dispersing the polymerizable monomer composition in an aqueous medium to carry out granulation, and polymerizing polymerizable monomers in the aqueous medium; and
   the magenta colorant comprises fine organic magenta pigment particles or fine organic magenta dye particles having an acetic acid adsorption heat in n-heptane of from 0.1 $mJ/m^2$ to 80 $mJ/m^2$;

iii) developing an electrostatic image formed on the latent image bearing member, using a yellow color toner to form a yellow toner image, wherein;
   the yellow color toner comprises yellow color toner particles containing a binder resin and a yellow colorant;
   the yellow color toner particles have been obtained by mixing a mixture containing at least a polymerizable monomer, the yellow colorant and a polymerization initiator to prepare a polymerizable monomer composition, dispersing the polymerizable monomer composition in an aqueous medium to carry out granulation, and polymerizing polymerizable monomers in the aqueous medium; and
   the yellow colorant comprises fine organic yellow pigment particles or fine organic yellow dye particles having an acetic acid adsorption heat in n-heptane of from 0.1 $mJ/m^2$ to 80 $mJ/m^2$; and iv) forming a multi-color image or a full-color image by the use of at least two of the cyan toner image, magenta toner image and yellow toner image formed.

DESCRIPTION OF THE PREFERRED EMBODIMENTS

Figure 1:
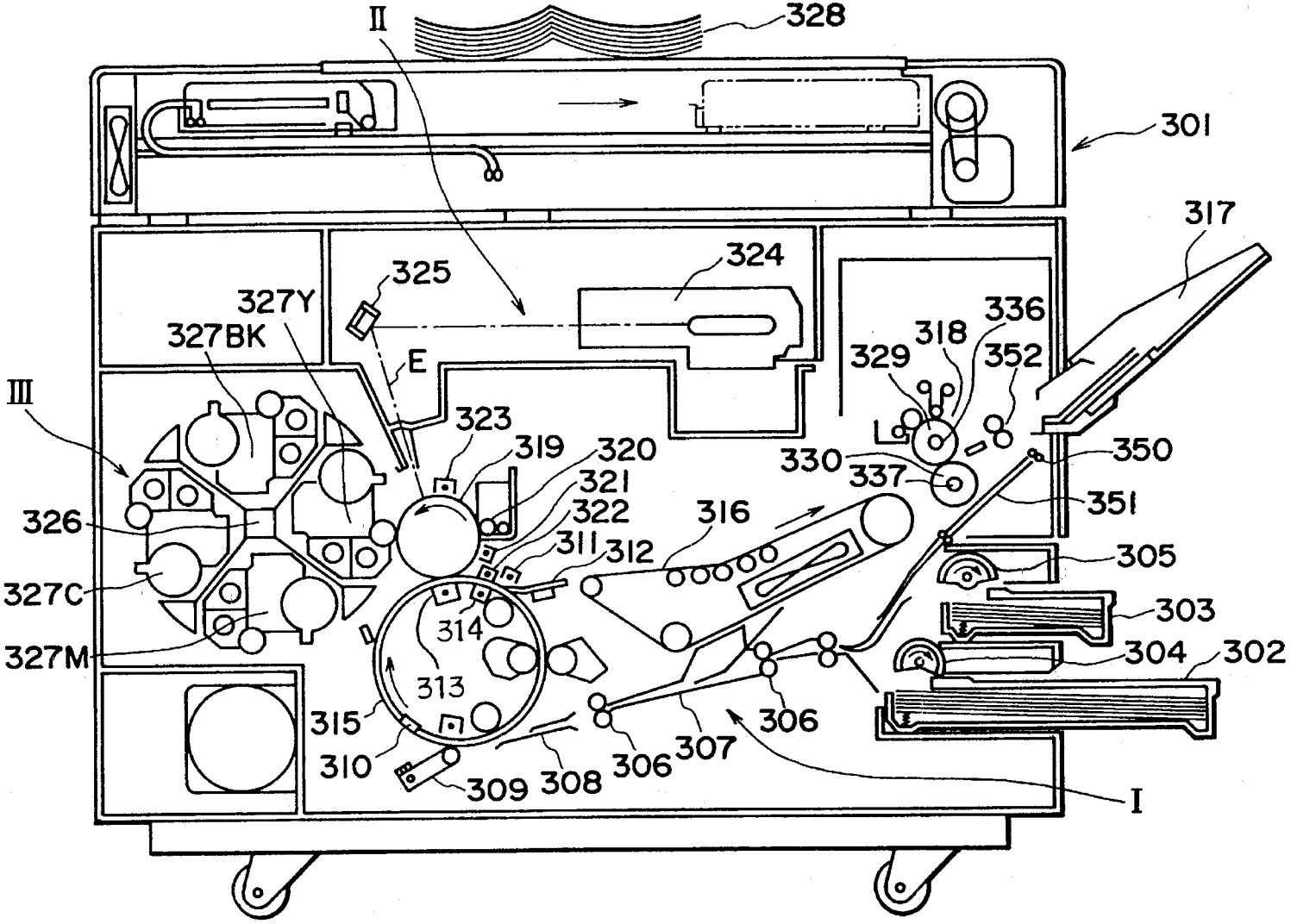
FIG. 1 illustrates an example for carrying out the color image forming method of the present invention.

As a result of extensive studies made on processes for producing toners by polymerization in an aqueous medium, the present inventors have discovered that the basicity of organic pigment particle surfaces or organic dye particle surfaces greatly affect the granulation performance in the aqueous medium and also the triboelectric charging performance of the resulting color toner. The adsorption of acetic acid on fine organic pigment particles or fine organic dye particles in a nonpolar solvent (n-heptane) tends to increase with an increase in the surface basicity thereof, and the quantity of heat of such adsorption (adsorption heat) serves as an indication for the surface basicity.

The fine organic pigment particles or fine organic dye particles used in the present invention have an acetic acid adsorption heat in n-heptane, of from 0.1 $mJ/m^2$ to 80 $mJ/m^2$ and preferably from 0.5 $mJ/m^2$ to 60 $mJ/m^2$.

If the fine organic pigment particles or fine organic dye particles have an acetic acid adsorption heat in n-heptane of less than 0.1 $mJ/m^2$ it becomes hard for the fine organic pigment particles or fine organic dye particles to be kept present on the surfaces of color toner particles, tending to cause charge-up of the toner. If on the other hand they have an acetic acid adsorption heat in n-heptane of more than 80 $mJ/m^2$, the granulation performance of polymerizable monomer compositions in the aqueous medium tends to become poor and the triboelectric charging performance of the toner tends to become lower.

The surface basicity of the fine organic pigment particles or fine organic dye particles is measured using a flow type microcalorimeter by determining equilibrium heat of adsorption of acetic acid in n-heptane while gradually increasing the concentration of the acetic acid. As the flow type microcalorimeter, for example, MARK-3 V (manufactured by Microscal Corp.) may be used.

Accordingly, as the organic pigment and organic dye used in the present invention, those having substantially no solubility in n-heptane and polymerizable monomers used should be selected.

Meanwhile, in order to calculate the quantity of heat of adsorption of acetic acid per 1 $m^2$, BET specific surface area of the same fine organic pigment particles or fine organic dye particles as those used to measure the acetic acid adsorption heat in n-heptane is measured using nitrogen gas.

The BET specific surface area of the fine organic pigment particles or fine organic dye particles may be measured using, for example, AUTOSORB 1 (manufactured by Yuasa Ionics Co.). The heat of adsorption determined by the above measurement is calculated into the heat of adsorption per 1 $m^2$ of BET specific surface area.

The fine organic pigment particles and fine organic dye particles may be those having a BET specific surface area of from 20 to 150 $m^2/g$, and preferably from 30 to 120 $m^2/g$, and an average particle diameter of from 0.01 to 0.5 μm, and preferably from 0.02 to 0.4 μm.

The fine organic pigment particles or fine organic dye particles, even when having the same chemical structure, undergo changes in their surface properties on account of their production process, post treatment and also surface treatment of the fine organic pigment particles or fine organic dye particles.

The organic pigment or dye used may preferably be made to have the above properties by applying a modification treatment when the pigment of dye is formed of in a post-treatment step. This is because the respective properties of the fine organic pigment particles or fine organic dye particles can be made uniform and controllable with ease by such a treatment.

The fine organic pigment particles of fine organic dye particles may preferably be modified by treating the surfaces of fine particles with a compound that remains solid at room temperature and has an acid group, e.g., a styrene-maleic acid copolymer, a styrene-acrylic acid copolymer, a styrene-methacrylic acid copolymer, a polyester resin, an addition product of abietic acid and maleic acid or a hydrogenated product of abietic acid to control the acetic acid adsorption heat in n-heptane so as to be from 0.1 to 80 $mJ/m^2$. For example, in a solution prepared by dissolving such a compound in an organic solvent, fine organic pigment particles or fine organic dye particles insoluble in the organic solvent may be dispersed, and then treated while stirring the dispersion in the presence of media such as balls made of glass, balls made of ceramic or balls made of steel, at a temperature of from 20° to 100° C., and preferably from 40° to 90° C., for 1 hour to 50 hours.

The organic pigment or organic dye preferably usable in the present invention may include the following.

As organic pigments or organic dyes used as the cyan colorant, it is possible to use copper phthalocyanine compounds and derivatives thereof, anthraquinone compounds and basic dye lake compounds, specifically including C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As organic pigments or organic dyes used as the magenta colorant, it is possible to use condensed azo compounds, diketopyrrolopyrrole compounds, anthraquinone compounds, quinacridone compounds, basic dye lake compounds, naphthol compounds, benzimidazolone compounds, thioindigo compounds and perillene compounds, specifically including C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As organic pigments or organic dyes used as the yellow colorant, it is possible to use compounds typified by condensed azo compounds, isoindolinone compounds, anthraquinone compounds, azo metal complexes, methine compounds, and allylamide compounds, specifically including C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 109, C.I. Pigment Yellow 110, C. I. Pigment Yellow 111, C.I. Pigment Yellow 120, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 175, C.I. Pigment Yellow 180, C.I. Pigment Yellow 181 and C.I. Pigment Yellow 194.

The above colorants may each be used in an amount of from 0.5 to 20 parts by weight, and more preferably from 1 to 15 parts by weight, based on 100 parts by weight of binder resin or 100 parts by weight of polymerizable monomers.

The polymerizable monomer may include vinyl monomers such as styrene; styrene derivatives such as o-methylstyrene, m-methylstyrene, p-methylstyrene, p-methoxylstyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamide.

Any of these vinyl monomers may be used alone or in combination. Of the foregoing vinyl monomers, styrene or a styrene derivative may preferably be used alone or in combination with an acrylate or methacrylate in view of developing performance and running performance of the toner.

As the polymerization initiator used in the present invention, a compound showing a half-life of 0.5 to 30 hours at the time of polymerization may be added in an amount of from 0.5 to 20% by weight based on the weight of the polymerizable monomer, whereby a polymer or copolymer having a maximum in the range of molecular weights of from 5,000 and 100,000 can be obtained and also favorable strength and suitable heat-melting properties can be imparted to the toner. The polymerization initiator may include azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutylonitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. In the present invention, a known chain transfer agent may be added to adjust the molecular weights.

In the present invention, a cross-linking agent may also be added, preferably in an amount of from 0.001 to 15% by weight.

In the present invention, a charge control agent may be added for the purpose of controlling the triboelectric charging performance of the color toner. The charge control agent may preferably have neither polymerization inhibitory action nor aqueous phase migratory action. For example, positive charge control agents may include triphenylmethane dyes, quaternary ammonium salts, and amine or imine compounds or polymers. Negative charge control agents may include salicylic acid or alkylsalicylic acid metal compounds, gold-containing monoazo dyes, carboxylic acid group- or sulfonic acid group-containing polymers, humic acid, and nitrohumic acid.

In order to improve low-temperature fixing performance of the color toner or improving releasability to heat-roll fixing members, the color toner particles may be incorporated with a low-temperature fluid component or low-surface energy substance such as silicone oil or wax.

The wax may include, for example, paraffin waxes, polyolefin waxes and modified products of these (e.g., oxides or graft-treated products), higher fatty acids and metal salts thereof, higher aliphatic alcohols, higher aliphatic esters and aliphatic amide waxes. These waxes may preferably have a softening point of from 30° to 130° C., and more preferably from 50° to 100° C. as measured by the ring and ball method (JIS K2531). The wax may preferably be dissolved in the polymerizable monomers. If its softening point is lower than 30° C., it becomes difficult for the wax to be held inside the toner particles. If the softening point is higher than 130° C., it becomes difficult for the wax to be dissolved in the polymerizable monomers, tending to make the dispersion of wax non-uniform and also resulting in an increase in viscosity of the polymerizable monomer composition to undesirably make the particle size distribution broader during granulation. Any of these waxes may preferably be added usually in an amount of from 5 to 30% by weight based on the weight of the color toner.

A silicone oil may also be used in order to improve releasability. The silicone oil may preferably be those having a viscosity at 25° C. of from 100 to 100,000 centistokes. If it is less than 100 centistokes, the release effect may become lower to tend to cause a problem on the retention of silicone oil in toner particles. The silicone oil, when used, may preferably be added in an amount of from usually from 0.1 to 10 parts by weight based on 100 parts by weight of polymerizable monomers.

When the polymerization conversion of the polymerizable monomers in the aqueous medium reaches 90% or more, toner particles no longer coalesce into masses even if stirring is stopped, and the reaction product may be taken out when the polymerization conversion reaches 97 to 98%, and then dried.

However, incorporation of a low-melting wax in a large quantity into color toner particles may cause a great decrease in developability when toners are left in an environment of high temperature, although images with a good quality can be obtained without any problem in usual environment.

In the suspension polymerization, the viscosity of the polymerizable monomer composition increases as the polymerization reaction proceeds, to make it hard for radical species and polymerizable vinyl monomers to move, so that unreacted polymerizable vinyl monomers tend to remain in color toner particles. In the case of toners produced by pulverization, any polymerizable monomers remaining can be removed by the heat applied during the preparation of binder resins or during melt-kneading. Since, however, no high heat must be applied to color toner particles when toners are directly formed by suspension polymerization, a large quantity of polymerizable monomers tend to exist inside the color toner particles compared with the color toners produced by pulverization. When the color toners produced by suspension polymerization are left to stand at a high temperature in the state where no water is present, unreacted polymerizable monomers remaining therein gradually volatilize from the surfaces of color toner particles, during which low-molecular weight components and non-polar components (e.g., a low-melting wax) inside the color toner particles are presumed to be transported toward the surface portions of color toner particles to cause a deterioration of developing performance of toners. In the color toner particles, volatile organic solvent components can be also present in a very small quantity in addition to the polymerizable monomers. Thus, controlling the content of these so as to be preferably not more than 1,000 ppm makes it possible to obtain a color toner that can be free from deterioration even when the toner containing a low-melting wax encapsulated in its particles is left in an environment of high temperature.

The color toner of the present invention can be produced by uniformly dissolving or dispersing a mixture containing at least the polymerizable monomer, the fine organic pigment particles or fine organic dye particles having an acetic acid adsorption heat in n-heptane of from 0.1 $mJ/m^2$ to 80 $mJ/m^2$ and the polymerization initiator (which may optionally further contain a wax, a charge control agent, a cross-linking agent, a magnetic material, an organic solvent, a release agent other than the wax, and so forth) by means of a dispersion machine such as a homogenizer, a ball mill, a colloid mill or an ultrasonic dispersion machine to prepare a polymerizable monomer composition, and then dispersing the polymerizable monomer composition in an aqueous medium containing a dispersion stabilizer to carry out granulation. In this step, in order to make the resulting color toner have a sharp particle size distribution, it is better to make color toner particles have the desired size at one time by the use of a high-speed stirrer or a high-speed dispersion machine such as an ultrasonic dispersion machine. As to the time when the polymerization initiator is to be added, it may be added at the same time when other additives are added in polymerizable monomers, or may be added right before they are suspended in the aqueous medium. A polymerization initiator dissolved in the polymerizable monomer or in a solvent may be further added immediately after the granulation and before the start of polymerization.

After the granulation, the particles may be stirred by means of a conventional stirrer to such an extent that the state of particles of the polymerizable monomer composition is maintained in the aqueous medium and the particles are prevented from floating and settling.

In the process for producing the color toner according to the present invention, known surface active agents or organic or inorganic dispersants may be used as the dispersion stabilizer. In particular, inorganic dispersants may preferably be used since they may hardly form harmful ultrafine powder, and have attained a dispersion stability because of their steric hindrance, and hence they may hardly cause a decrease in the stability even when reaction temperature is changed, enable easy washing and may hardly adversely affect the toner. Such inorganic dispersants can be exemplified by fine phosphoric acid polyvalent metal salt powders such as calcium phosphate, magnesium phosphate, aluminum phosphate and zinc phosphate; fine carbonate powders such as calcium carbonate and magnesium carbonate; fine inorganic salt powders such as calcium metasilicate, calcium sulfate and barium sulfate; and fine inorganic hydroxide of oxide powders such as calcium hydroxide, magnesium hydroxide, aluminum hydroxide, silica, bentonite and alumina.

Any of these inorganic dispersants may preferably be used alone in an amount of from 0.2 to 20 parts by weight based on 100 parts by weight of the polymerizable vinyl monomer. As occasion calls, 0.001 to 0.1 part by weight of a surface active agent may be used in combination. The surface active agent may include, for example, sodium dodecylbenzenesulfonate, sodium tetradecylsulfate, sodium pentadecylsulfate, sodium octylsulfate, sodium oleate, sodium laurate, sodium stearate and potassium stearate.

When these inorganic dispersants are used, these may be used as they are. However, in order to obtain fine inorganic dispersant particles, it is preferable to form particles of the inorganic dispersant in the aqueous medium. For example, in the case of calcium phosphate, an aqueous sodium phosphate solution and an aqueous calcium chloride solution may be mixed to form fine particles of water-insoluble calcium phosphate. This enables uniform dispersion and is highly effective for achieving the stability. On this occasion, a by-product water-soluble sodium chloride is formed, but the presence of water-soluble salts in the aqueous medium inhibits the dissolution of polymerizable vinyl monomers in water to make it hard for ultrafine toner particles to be produced on emulsion polymerization. Thus, this is more advantageous. Sodium chloride is an obstacle when the remaining polymerizable vinyl monomers are removed at the stage where the polymerization is completed, and hence it is better to change the aqueous medium for new one or to carry out desalting of the aqueous medium by using an ion-exchange resin. The inorganic dispersant can be removed by dissolving it with an acid or alkali after the polymerization is completed.

In view of the granulation performance of the polymerizable monomer composition, the aqueous medium may preferably have a pH of 7 or more, and more preferably a pH of from 7.5 to 10.5, in relation to the fine organic pigment particles or fine organic dye particles having an acetic acid adsorption heat in n-heptane of 0.1 to 80 $mJ/m^2$.

In the step of polymerization, the polymerization is carried out at a polymerization temperature set at 40° C. or above, and usually at 50° to 90° C. When the polymerization is carried out within this temperature range, the wax to be enclosed inside toner particles becomes deposited on account of phase separation as the polymerization proceeds, so that the encapsulation can be made more perfect. In order to use up the remaining polymerizable vinyl monomers, the reaction temperature may be raised to 90° to 150° C. at the stage where the polymerization is completed.

Under such conditions, the polymerization conversion can be substantially linearly increased up to a conversion of 90%. However, the increase in the degree of polymerization becomes slow at a polymerization conversion of more than 90% where the polymerizable vinyl monomer composition becomes solid, and it becomes very slow at a polymerization conversion of more than 95%. The polymerization reaction may be allowed to proceed as is, and may be so operated that the content of the remaining polymerizable vinyl monomer is made preferably not more than 1,000 ppm. A method of accelerating the consumption of polymerizable monomers, known in the art in suspension polymerization, may also be used.

As a method employed in the process for producing the color toner according to the present invention, there is a method in which the liquid temperature of the aqueous medium is further raised by 20° to 60° C. at the time the polymerization conversion reaches 95% or more so that the viscosity is decreased by heat and the consumption of polymerizable vinyl monomers can be accelerated by the initiation of thermal polymerization. On this occasion, the polymerizable vinyl monomers can be effectively used up when a polymerization initiator capable of being decomposed at a high temperature is kept present together in the polymerizable vinyl monomer composition.

It is more preferable to evaporate the unreacted polymerizable vinyl monomer under reduced pressure to make their residual content not more than 1,000 ppm. It is also possible to make the residual content of the polymerizable vinyl monomer not more than 1,000 ppm by exposing toner particles swelled with water, to supersaturated water vapor while cooling the water vapor to 40° to 50° C.

As a method of removing the unreacted polymerizable vinyl monomers, there are a method in which toner particles are washed with a highly volatile organic solvent capable of not dissolving the binder resin of toner particles but dissolving the polymerizable vinyl monomer components, a method in which toner particles are washed with an acid or alkali, and a method in which a foaming agent or a solvent component that does not dissolve polymers is put in the polymer system to make toner particles porous so that the polymerizable vinyl monomer components inside toner particles can have a larger volatility area. Since it is difficult to select the solvent when the desired attributes of the toner such that toner constituents dissolve out and organic solvents remain are taken into account, it is most preferable to use a method in which the polymerizable vinyl monomer components are volatilized under reduced pressure.

The content of the remaining polymerizable vinyl monomer may preferably be finally made to be at least 1,000 ppm. In order to prevent disagreeable odors that may be given out during fixing, due to the polymerizable vinyl monomer and reaction residues thereof, the content thereof may more preferably be made not more than 700 ppm, and still more preferably not more than 300 ppm.

The conversion of polymerization is measured using a sample prepared by adding a polymerization inhibitor to 1 g of the suspension and dissolving them in 4 ml of THF (tetrahydrofuran). The remaining polymerizable vinyl monomer and a remaining organic solvent are determined using a sample prepared by dissolving 0.2 g of toner in 4 ml of THF, and the sample is subjected to gas chromatography (G.C.) to make measurement by the internal standard method under the following conditions.

G.C. conditions

Measuring device: Shimadzu GC-15 A (with a capillary)

Carrier: $N_2$, 2 $kg/cm^2$ 50 ml/min.

Split ratio: 1:60

Linear velocity: 30 mm/sec.

Column: ULBON HR-1 50 m×0.25 mm

Temperature programming:

50° C., 5 min. hold;

raised to 100° C. by 10° C./min.; and raised to 200° C. (hold) by 20° C./min.

Amount of sample: 2 μl

Indicator: Toluene

In the present invention, the particle size distribution of the color toner particles is measured in the following way.

A Coulter counter Model TA-II (manufactured by Coulter Electronics, Inc.) is used as a measuring device. An interface (manufactured by Nikkaki k.k.) that outputs number average distribution and volume average distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 0.5 to 50 mg of a sample to be measured. The electrolytic solution in which the sample has been suspended is subjected to dispersion for about 1 minute to about 3 minutes in an ultrasonic dispersion machine. The volume average distribution and number average distribution of particles are calculated by measuring the particle size distribution of toner particles of 2 to 40 μm by means of the above Coulter counter Model TA-II, using an aperture of 100 μm as its aperture. The content of color toner particles with particle diameters not larger than 4 μm, and the content of color toner particles with particle diameters not smaller than 12.7 μm and their weight average particle diameter (D4) are determined from the volume average distribution and number average distribution obtained.

The color toner of the present invention may preferably have a weight average particle diameter of from 3 to 10 μm, a coefficient of variation of particle size distribution of from 15 to 35, and more preferably from 15 to 30, and contain color toner particles with particle diameters not smaller than 12.7 μm in an amount of not more than 5% by volume, and more preferably not more than 1% by volume.

In order to more improve various performances of the color toner of the present invention, the color toner particles may preferably have been mixed with external additives.

The external additives used for the purpose of providing various properties may each preferably have a particle diameter of not more than 1/10 of the weight average diameter of the toner particles in view of durability required when mixed in toners. This particle diameter of the additives is meant to be an average particle diameter measured using an electron microscope by observing surfaces of toner particles. As these properties-providing additives, for example, the following can be used. 1) Fluidity-providing agents: Metal oxides such as silicon oxide, aluminum oxide and titanium oxide, carbon black, and carbon fluoride. These may more preferably have been subjected to hydrophobic treatment. 2) Abrasives: Metal compounds including metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate. 3) Lubricants: Fluorine resin powders such as vinylidene fluoride and polytetrafluoroethylene, and fatty acid metal salts such as zinc stearate and calcium stearate. 4) Charge controlling particles: Metal oxides such as tin oxide, titanium oxide, zinc oxide, silicon oxide and aluminum oxide, and carbon black.

Any of these additives may preferably be used in an amount of from 0.1 part to 10 parts by weight, and preferably from 0.1 part to 5 parts by weight, based on 100 parts by weight of the color toner particles. These additives may be used alone or in combination of plural ones.

An image forming apparatus that can preferably carry out the color image forming method of the present invention will be described below with reference to FIG. 1.

FIG. 1 schematically illustrates a color electrophotographic apparatus, which is roughly grouped into a transfer medium transport system I so provided as to extend from the right side (the right side in FIG. 1) of the main body 301 of the apparatus to substantially the middle of the main body 301 of the apparatus, a latent image forming zone II provided in substantially the middle of the main body 301 of the apparatus and in proximity to a transfer drum 315 constituting the transfer medium transport system I, and a developing means, i.e., a rotary developing unit III, provided in proximity to the latent image forming zone II.

The transfer medium transport system I described above is constructed in the following way. It has openings formed on the right side (the right side in FIG. 1) of the main body 301 of the apparatus, and is provided with transfer medium feeding trays 302 and 303 detachable through the openings in the manner that they partly extend toward the outside of the apparatus. Paper feed rollers 304 and 305 are provided almost directly above the trays 302 and 303, respectively, and another paper feed roller 306 and paper guides 307 and 308 are provided in the manner that the paper feed rollers 304 and 305 can be associated with the transfer drum 315 provided on the left side and rotatable in the direction of an arrow. A contacting roller 309, a gripper 310, a transfer medium separating corona assembly 311 and a separating claw 312 are sequentially provided in the vicinity of the periphery of the transfer drum 315 from the upstream side to the downstream side in the direction of its rotation.

A transfer corona assembly 313 and a transfer medium separating corona assembly 314 are provided inside the periphery of the transfer drum 315. A transfer sheet (not shown) formed of a polymer such as polyvinylidene fluoride is stuck to the part where transfer mediums on the transfer drum 315 wind around, and the transfer mediums are electrostatically brought into close contact with the surface of the transfer sheet. A paper delivery belt means 316 is provided in proximity to the separating claw 312 at the right upper part of the transfer drum 315, and a fixing assembly 318 is provided at the terminal (the right side) of the transfer medium transport direction of the paper delivery belt means 316. A paper output tray 317 extending to the outside of the main body 301 of the apparatus and detachable from the main body 301 thereof is provided more downstream in the transport direction than the fixing assembly 318.

The latent image forming zone II is constructed as described below. As a latent image bearing member, a photosensitive drum 319 (e.g. an OPC photosensitive drum or an amorphous silicon drum) rotatable in the direction of an arrow in FIG. 1 is provided in the manner that its periphery comes into contact with the periphery of the transfer drum 315. Above the photosensitive drum 319 and in the vicinity of the periphery thereof, a residual charge eliminating corona assembly 320, a cleaning means 321 and a primary corona assembly 323 are sequentially provided from the upstream side to the down stream side in the direction of rotation of the photosensitive drum 319. An imagewise exposure means 324 such as a laser beam scanner to form an electrostatic latent image on the periphery of the photosensitive drum 319, and an imagewise exposing light reflecting means such as a polygon mirror are also provided.

The rotary developing unit III is constructed in the following way. It comprises a rotatable housing (hereinafter "rotating support") 326 provided at the position facing the periphery of the photosensitive drum 319. In the rotating support 326, four kinds of developing assemblies are independently mounted and are so constructed that electrostatic latent images formed on the periphery of the photosensitive drum 319 can be converted into visible images (i.e., developed). The four kinds of developing assemblies comprise a yellow developing assembly 327Y, a magenta developing assembly 327M, a cyan developing assembly 327C and a black developing assembly 327BK, respectively.

The sequence of the whole image forming apparatus constructed as described above will be described by giving an example of full-color mode image formation. With the rotation of the above photosensitive drum 319 in the direction of the arrow in FIG. 1, a photosensitive layer on the photosensitive drum 319 is electrostatically charged by means of the primary corona assembly 323. In the apparatus shown in FIG. 1, each component part is operated at a process speed of 100 mm/sec or higher, e.g., 130 to 250 mm/sec. Upon the electrostatic charging on the photosensitive drum 319 by means of the primary corona assembly 323, imagewise exposure is carried out using laser light E modulated by yellow image signals of an original 328, so that an electrostatic latent image is formed on the photosensitive drum 319, and then the electrostatic latent image is developed by means of the yellow developing assembly 327Y previously set stationary at a developing position by the rotation of the rotating support 326. Thus, a yellow toner image is formed.

The transfer medium transported through the paper feed guide 307, paper feed roller 306 and paper feed guide 308 is held fast by the gripper 310 at a given timing, and is electrostatically wound around the transfer drum 315 by means of the contacting roller 309 and an electrode set opposingly to the contacting roller 309. The transfer drum 315 is rotated in the direction of the arrow in FIG. 1 in synchronization with the photosensitive drum 319. The yellow toner image formed by the development with the yellow developing assembly 327Y is transferred to the transfer medium by means of the transfer corona assembly 313 at the portion where the periphery of the photosensitive drum 319 and the periphery of the transfer drum 315 come into contact with each other. The transfer drum 315 is continued rotating without stop, and stands ready for a next color (magenta as viewed in FIG. 1).

The photosensitive drum 319 is destaticized by means of the residual charge eliminating corona assembly 320, and is cleaned through the cleaning means 321. Thereafter, it is again electrostatically charged by means of the primary corona assembly 323, and-is subjected to imagewise exposure according to the next magenta image signals, where an electrostatic latent image is formed. The above rotary developing unit is rotated while the electrostatic latent image formed on the photosensitive drum 319 according to the magenta image signals as a result of the imagewise exposure, until the magenta developing assembly 327M is set stationary at the above given developing position, where the development is carried out using a given magenta toner. Subsequently, the process as described above is also carried out on a cyan color and optionally a black color each. After transfer steps corresponding to the three (or four) colors have been completed, a three-color visible image formed on the transfer medium is destaticized by the corona assemblies 322 and 314, and the transfer medium held by the gripper 6 is released therefrom. At the same time, the transfer medium is separated from the transfer drum 315 by means of the separating claw 312, and then delivered to the fixing assembly 318 over the delivery belt 316, where the image is fixed by the action of heat and pressure. Thus, the sequence of full-color print is completed and the desired full-color print image is formed on one side of the transfer medium.

In the color image forming method of the present invention, the color toner images may be transferred from the photosensitive drum to an intermediate transfer medium and the color toner images may be further transferred from the intermediate transfer medium to a transfer medium such as plain paper or plastic film, followed by fixing of color toner images on the transfer medium to form a multi-color image or full-color image.

EXAMPLES

The present invention will be described below in greater detail by giving Examples and Comparative Examples.

EXAMPLE 1

In 50 parts by weight of a tetrahydrofuran solution in which 1 part by weight of a styrene-maleic acid copolymer (copolymerization weight ratio: 80:20; weight average molecular weight: 20,000) had been dissolved, 10 parts by weight of fine particles of copper phthalocyanine pigment (C.I. Pigment Blue 15:3; acetic acid adsorption heat in n-heptane: 124 mJ/m$^2$; BET specific surface area: 38 m$^2$/g) were dispersed, and the dispersion was Stirred at a temperature of 40° C. for 10 hours in the presence of 50 parts by weight of glass balls of 2 to 3 cm diameter. After the stirring, the glass balls were removed, and then the fine copper phthalocyanine pigment particles thus modified were separated from the tetrahydrofuran solution by filtration. The fine copper phthalocyanine pigment particles obtained had an acetic acid adsorption heat in n-heptane of 18 mJ/m$^2$ and a BET specific surface area of 41 m$^2$/g. The copper phthalocyanine pigment used was substantially insoluble in n-heptane (dissolution per 100 g of n-heptane: 0.1 g or less).

Into 709 parts by weight of ion-exchanged water, 451 parts by weight of an aqueous 0.1M $Na_3PO_4$ solution was charged, and the mixture was heated to 60° C., followed by little-by-little addition of 67.7 parts by weight of an aqueous 1.0M $CaCl_2$ solution to prepare an aqueous medium (pH: 9.5) in which fine particles of $Ca_3(PO_4)_2$ had been dispersed.

| | (by weight) |
|---|---|
| Styrene | 170 parts |
| n-Butyl acrylate | 30 parts |
| Surface-treated copper phthalocyanine pigment particles (acetic acid adsorption heat: 18 mJ/m2) | 10 parts |
| Paraffin wax (melting point: 75° C.) | 40 parts |
| Di-t-butylsalicylic acid metal compound | 5 parts |
| Unsaturated polyester resin (a condensate of propoxylated bisphenol A and fumaric acid; acid value: 8.5; weight average molecular weight: 50,000) | 4 parts |

The above materials were heated to 60° C., and then uniformly mixed, dispersed and dissolved using a TK homomixer (manufactured by Tokushu Kika Kogyo) at 12,000 r.p.m. In the resulting solution, as polymerization initiators 10 parts by weight of 2,2'-azobis(2,4-dimethylvaleronitrile) (half-life at a temperature of 60° C.: 140 min) and 1 part by weight of dimethyl-2,2'-azobisisobutyrate (half-life at a temperature of 60° C.: 1,270 min; half-life at a temperature of 80° C.: 80 min) were dissolved. A polymerizable monomer composition was thus prepared.

The copper phthalocyanine pigment was substantially insoluble in styrene and n-butyl acrylate.

The polymerizable monomer composition obtained was charged into the above aqueous medium, followed by stirring at 10,000 rpm for 20 minutes at 60° C. using the TK homomixer in an atmosphere of nitrogen, to carry out granulation to form suspension droplets with size of toner particles. Thereafter, while stirring with paddle stirring blades, the reaction was carried out at a temperature of 60° C. for 3 hours. Thereafter, the reflux of water vapor was stopped and the liquid temperature was raised to 80° C. to carry out polymerization for further 10 hours. After the polymerization was completed, the suspension was cooled, and hydrochloric acid was added to dissolve the fine particles of $Ca_3(PO_4)_2$, followed by filtration, washing with water and then drying to obtain a polymerization cyan color toner with a weight average particle diameter of 8.2 μm. This polymerization cyan color toner was deaerated for 12 hours at 45° C. under reduced pressure of 50 mmHg. At this stage, polymerizable monomers remaining in the toner were in a content of 35 ppm.

Physical properties of the cyan color toner obtained are shown in Table 1.

Based on 100 parts by weight of the cyan color toner thus obtained, 0.8 part by weight of hydrophobic fine silica powder was externally added. Next, 30 parts by weight of the silica-externally-added toner and 570 parts by weight of a resin-coated ferrite carrier were blended to produce a two-component type developer.

Using this developer, images were reproduced using a modified machine of a commercially available color copying machine (CLC-500, manufactured by Canon Inc.). Development was carried out under conditions of a development contrast of 320 V in an environment of 23° C./65%RH. Images obtained were good and also had a satisfactory light-fastness.

The results are shown in Table 2.

Comparative Example 1

A cyan color toner was prepared in the same manner as in Example 1 except for using untreated fine particles of copper phthalocyanine pigment (C.I. Pigment Blue 15; acetic acid adsorption heat in n-heptane: 124 mJ/m$^2$). The cyan color toner thus obtained had a broader particle size distribution than the cyan color toner produced in Example 1 and showed an inferior triboelectric charging performance.

EXAMPLE 2

A magenta color toner was prepared in the same manner as in Example 1 except for using 10 parts by weight of fine particles of quinacridone pigment (C.I. Pigment Red 122; acetic acid adsorption heat in n-heptane: 58 mJ/m$^2$; BET specific surface area: 43 m$^2$/g) obtained by subjecting a quinacridone pigment substantially insoluble in n-heptane, styrene and n-butyl acrylate to the same surface-treatment as in Example 1.

Physical properties of the magenta color toner obtained are shown in Table 1.

Images were also reproduced in the same manner as in Example 1 to obtain the results shown in Table 2.

Comparative Example 2

A magenta color toner was prepared in the same manner as in Example 2 except for using untreated fine particles of quinacridone pigment (C.I. Pigment Red 122; acetic acid adsorption heat in n-heptane: 105 mJ/m$^2$; BET specific surface area: 55 m$^2$/g). The magenta color toner thus obtained had a broader particle size distribution than the magenta color toner produced in Example 2 and showed an inferior triboelectric charging performance.

EXAMPLE 3

A yellow color toner was prepared in the same manner as in Example 1 except for using 10 parts by weight of fine particles of disazo yellow pigment (C.I. Pigment Yellow 17; acetic acid adsorption heat in n-heptane: 67 mJ/m$^2$; BET specific surface area: 45 m$^2$/g) obtained by subjecting a disazo yellow pigment substantially insoluble in n-heptane, styrene and n-butyl acrylate to the same surface-treatment as in Example 1.

Physical properties of the yellow color toner obtained are shown in Table =b 1.

Images were also reproduced in the same manner as in Example 1 to obtain the results shown in Table 2.

Comparative Example 3

A yellow color toner was prepared in the same manner as in Example 3 except for using untreated fine particles of disazo yellow pigment (C.I. Pigment Yellow 17; acetic acid adsorption heat in n-heptane: 85 mJ/m$^2$; BET specific surface area: 30 m$^2$/g). The yellow color toner thus obtained had a broader particle size distribution than the yellow color toner produced in Example 3 and showed an inferior triboelectric charging performance.

TABLE 1

| Weight average particle diameter of toner (μm) | Content of toner particles with particle diameters of: ≦4 μm (% by number) | ≧12.7 μm (% by volume) | Coefficient of variation of toner | Monomer content (ppm) | Quantity of triboelectricity of toner External additive: None (μc/g) | Added (μc/g) |
|---|---|---|---|---|---|---|
| Example 1 | | | | | | |
| 8.5 | 30.2 | 0.1 | 24 | 35 | −52 | −35 |
| Comparative Example 1 | | | | | | |
| 8.7 | 50.5 | 2.3 | 36 | 42 | −34 | −30 |
| Example 2 | | | | | | |
| 8.0 | 25.0 | 0.1 | 22 | 32 | −47 | −35 |
| Comparative Example 2 | | | | | | |
| 8.3 | 65.5 | 5.7 | 37 | 40 | −15 | −10 |
| Example 3 | | | | | | |
| 8.3 | 28.6 | 0.1 | 23 | 43 | −55 | −42 |
| Comparative Example 3 | | | | | | |
| 8.7 | 72.0 | 4.8 | 37 | 62 | −32 | −25 |

TABLE 2

| Image density | | | | |
|---|---|---|---|---|
| | After | Fog | | |
| Initial stage | 10,000 sh. running | Initial stage | 10,000 sh. running | Resolution |
| Example 1 | | | | |
| 1.80 | 1.82 | A | A | A |
| Comparative Example 1 | | | | |
| 1.75 | 1.65 | A | C | B |
| Example 2 | | | | |
| 1.83 | 1.85 | A | A | A |
| Comparative Example 2 | | | | |
| 1.61 | 1.61 | B | C | C |
| Example 3 | | | | |
| 1.82 | 1.81 | A | A | A |
| Comparative Example 3 | | | | |
| 1.60 | 1.63 | B | C | B |

Remarks:
1) Evaluation: A: Excellent; B: Passable; C: Poor
2) Image density was measured using a Macbeth densitometer or a color reflection densitometer X-RITE 404A, manufactured by X-Rite Co.

EXAMPLE 4

Using the cyan color toner produced in Example 1, the magenta color toner produced in Example 2 and the yellow color toner produced in Example 3, image reproduction was tested in a full-color mode. Full-color images obtained were sharp, and had color tones having faithfully reproduced full-color original tones.

Comparative Example 4

Using the cyan color toner produced in Comparative Example 1, the magenta color toner produced in Comparative Example 2 and the yellow color toner produced in Comparative Example 3, image reproduction was tested in a full-color mode. Full-color images obtained had a sharpness and a color tone reproduction both inferior to those of the full-color images obtained in Example 4.

What is claimed is:

1. A color toner for developing an electrostatic image, comprising color toner particles containing a binder resin and a colorant;

said color toner particles having been obtained by mixing a mixture containing at least a polymerizable monomer, the colorant and a polymerization initiator to prepare a polymerizable monomer composition, dispersing the polymerizable monomer composition in an aqueous medium to carry out granulation, and polymerizing polymerizable monomers in the aqueous medium;

wherein the colorant comprises fine organic pigment particles or fine organic dye particles having an acetic acid adsorption heat in n-heptane from 0.1 $mJ/m^2$ to 80 $mJ/m^2$ and a BET specific surface area from 20 $m^2/g$ to 150 $m^2/g$.

2. The color toner according to claim 1, wherein said fine organic pigment particles or fine organic dye particles are fine organic cyan pigment particles or fine organic cyan dye particles, and are substantially insoluble in n-heptane and the polymerizable monomers.

3. The color toner according to claim 1, wherein said fine organic pigment particles or fine organic dye particles are fine organic magenta pigment particles or fine organic magenta dye particles, and are substantially insoluble in n-heptane and the polymerizable monomers.

4. The color toner according to claim 1, wherein said fine organic pigment particles or fine organic dye particles are fine organic yellow pigment particles or fine organic yellow dye particles, and are substantially insoluble in n-heptane and the polymerizable monomers.

5. The color toner according to claim 1, wherein said fine organic pigment particles or fine organic dye particles have a BET specific surface area of from 30 $m^2/g$ to 120 $m^2/g$.

6. The color toner according to claim 1, wherein said fine organic pigment particles or fine organic dye particles have an acetic acid adsorption heat in n-heptane of from 0.5 $mJ/m^2$ to 60 $mJ/m^2$.

7. The color toner according to claim 1, wherein said polymerizable monomer comprises a vinyl monomer.

8. The color toner according to claim 7, wherein said polymerizable monomer is styrene, a styrene derivative, an acrylic monomer, a methacrylic monomer, or a mixture of any of these.

9. The color toner according to claim 1, wherein said color toner has a weight average particle diameter of from 3 μm to 10 μm and a coefficient of variation of particle size distribution of from 15 to 35, and has color toner particles with particle diameters not smaller than 12.7 μm in a content of not more than 5% by volume.

10. The color toner according to claim 9, wherein the coefficient of variation of particle size distribution of said color toner is from 15 to 30, and the content of color toner particles with particle diameters not smaller than 12.7 μm is not more than 1% by volume.

11. The color toner according to claim 1, wherein the color toner contains said fine organic pigment particles or fine organic dye particles in an amount of from 0.5 part by weight to 15 parts by weight based on 100 parts by weight of the binder resin.

12. The color toner according to claim 1, wherein the color toner contains a wax.

13. The color toner according to claim 1, wherein said color toner particles are colored resin particles produced by suspension polymerization.

14. The color toner according to claim 1, wherein said color toner particles are colored resin particles produced by emulsion polymerization.

15. A process for producing a color toner, comprising the steps of:

mixing a mixture containing at least a polymerizable monomer, a color and a polymerization initiator to prepare a polymerizable monomer composition, wherein the colorant comprises fine organic pigment particles or fine organic dye particles having an acetic acid adsorption heat in n-heptane of from 0.1 $mJ/^2$ to 80 $mJ/m^2$ and a BET specific surface area from 20 $m^2/g$ to 150 $m^2/g$;

dispersing the polymerizable monomer composition in an aqueous medium to carry out granulation; and polymerizing polymerizable monomers in the aqueous medium.

16. The process according to claim 15, wherein said fine organic pigment particles or fine organic dye particles have an acetic acid adsorption heat in n-heptane from 0.5 $mJ/m^2$ to 60 $mJ/m^2$ and are substantially insoluble in n-heptane and the polymerizable monomers.

17. The process according to claim 15, wherein said polymerizable monomer comprises a vinyl monomer.

18. The process according to claim 17, wherein said polymerizable monomer is styrene, a styrene derivative, an acrylic monomer, a methacrylic monomer, or a mixture of any of these.

19. The process according to claim 15, wherein said fine organic pigment particles of fine organic dye particles are previously treated with a compound that stands solid at room temperature and has an acid group, before mixed with the polymerizable monomers.

20. The process according to claim 15, wherein said aqueous medium contains an inorganic dispersion stabilizer and has a pH of 7 or above.

21. The process according to claim 15, wherein said fine organic pigment particles or fine organic dye particles are fine organic cyan pigment particles or fine organic cyan dye particles, and are substantially insoluble in n-heptane and the polymerizable monomers.

22. The process according to claim 15, wherein said fine organic pigment particles or fine organic dye particles are fine organic magenta pigment particles or fine organic magenta dye particles, and are substantially insoluble in n-heptane and the polymerizable monomers.

23. The process according to claim 15, wherein said fine organic pigment particles or fine organic dye particles are fine organic yellow pigment particles or fine organic yellow dye particles, and are substantially insoluble in n-heptane and the polymerizable monomers.

24. The process according to claim 15, wherein said polymerizable monomers are polymerized by suspension polymerization.

25. The process according to claim 15, wherein said polymerizable monomers are polymerized by emulsion polymerization.

26. The process according to claim 15, wherein said color toner particles are treated to remove the polymerizable monomer.

27. The process according to claim 21, wherein said aqueous medium contains an inorganic dispersion stabilizer and has a pH of from 7.5 to 10.5.

28. A color image forming method comprising:

(a) developing an electrostatic image formed on a latent image bearing member, using a cyan color toner to form a cyan color toner image, wherein;

said cyan color toner comprises cyan color toner particles containing a binder resin and a cyan colorant;

said cyan color toner particles have been obtained by mixing a mixture containing at least a polymerizable monomer, the cyan colorant and a polymerization initiator to prepare a polymerizable monomer composition, dispersing the polymerizable monomer composition in an aqueous medium to carry out granulation, and polymerizing polymerizable monomers in the aqueous medium; and said cyan colorant comprises fine organic cyan pigment particles or fine organic cyan dye particles having an acetic acid adsorption heat in n-heptane from 0.1 $mJ/m^2$ to 80 $mJ/m^2$ and a BET specific surface area from 20 $m^2/g$ to 150 $m^2/g$;

(b) developing an electrostatic image formed on the latent image bearing member, using a magenta color toner to form a magenta color toner image, wherein;

said magenta color toner comprises magenta color toner particles containing a binder resin and a magenta colorant;

said magenta color toner particles have been obtained by mixing a mixture containing at least a polymerizable monomer, the magenta colorant and a polymerization initiator to prepare a polymerizable monomer composition, dispersing the polymerizable monomer composition in an aqueous medium to carry out granulation, and polymerizing polymerizable monomers in the aqueous medium; and said magenta colorant comprises fine organic magenta pigment particles or fine organic magenta dye particles having an acetic acid adsorption heat in n-heptane from 0.1 $mJ/m^2$ to 80 $mJ/m^2$ and a BET specific surface area from 20 $m^2/g$ to 150 $m^2/g$;

(c) developing an electrostatic image formed on the latent image bearing member, using a yellow color toner to form a yellow color toner image, wherein;

said yellow color toner comprises yellow color toner particles containing a binder resin and a yellow colorant;

said yellow color toner particles have been obtained by mixing a mixture containing at least a polymerizable monomer, the yellow colorant and a polymerization initiator to prepare a polymerizable monomer composition, dispersing the polymerizable monomer composition in an aqueous medium to carry out granulation, and polymerizing polymerizable monomers in the aqueous medium; and said yellow colorant comprises fine organic yellow pigment particles or fine organic yellow dye particles having an acetic acid adsorption heat in n-heptane from 0.1 $mJ/m^2$ to 80 $m/Jm^2$ and a BET specific surface area from 20 $m^2/g$ to 150 $m^2/g$; and (d) forming a multi-color image or a full-color image by the use of at least two of the cyan color toner image, magenta color toner image and yellow color toner image formed.

29. The color image forming method according to claim 28, wherein said cyan color toner particles, said magenta color toner particles and said yellow color toner particles are colored resin particles produced by suspension polymerization.

30. The color image forming method according to claim 28, wherein said cyan color toner image, said magenta color toner image and said yellow color toner image are finally fixed onto a transfer medium under application of heat and pressure.

* * * * *

UNITED STATES PATENT AND TRADEMARK OFFICE

CERTIFICATE OF CORRECTION

PATENT NO. : 5,578,407

DATED : November 26, 1996

INVENTOR(S) : TAKASHIGE KASUYA, ET AL.

It is certified that error appears in the above-identified patent and that said Letters Patent is hereby corrected as shown below:

COLUMN 2

Line 15, "of" should read --or--.
Line 29, "still,sought" should read --still sought--.

COLUMN 4

Line 36, "0.1 $mJ/m^2$" should read --0.1 $mJ/m^2$,--.

COLUMN 5

Line 9, "post treatment" should read --post-treatment--.
Line 14, "of" should read --or-- (both occurrences).
Line 19, "of" should read --or--.

COLUMN 8

Line 57, "of" should read --or--.

COLUMN 12

Line 41, "down stream" should read --downstream--.

COLUMN 13

Line 30, "and-is" should read --and is--.
Line 44, "gripper 6" should read --gripper 310--.

COLUMN 14

Line 6, "Stirred" should read --stirred--.

UNITED STATES PATENT AND TRADEMARK OFFICE

CERTIFICATE OF CORRECTION

PATENT NO. : 5,578,407

DATED : November 26, 1996

INVENTOR(S) : TAKASHIGE KASUYA, ET AL. Page 2 of 2

It is certified that error appears in the above-identified patent and that said Letters Patent is hereby corrected as shown below:

COLUMN 16

Line 24, "Table =b 1." should read --Table 1.--.

COLUMN 19

Line 6, "of" should read --or--.
Line 8, "mixed" should read --being mixed--.
Line 37, "claim 21," should read --claim 20,--.

Signed and Sealed this

Twentieth Day of May, 1997

*Attest:*

*Attesting Officer*

BRUCE LEHMAN

*Commissioner of Patents and Trademarks*